US011857863B2

(12) United States Patent
Murray et al.

(10) Patent No.: US 11,857,863 B2
(45) Date of Patent: Jan. 2, 2024

(54) SHOESKI

(71) Applicants: Aaron N. Murray, North Salt Lake, UT (US); Amber N. Murray, North Salt Lake, UT (US)

(72) Inventors: Aaron N. Murray, North Salt Lake, UT (US); Amber N. Murray, North Salt Lake, UT (US)

( * ) Notice: Subject to any disclaimer, the term of this patent is extended or adjusted under 35 U.S.C. 154(b) by 0 days.

(21) Appl. No.: 17/841,934

(22) Filed: Jun. 16, 2022

(65) Prior Publication Data

US 2022/0401818 A1 Dec. 22, 2022

Related U.S. Application Data

(60) Provisional application No. 63/211,415, filed on Jun. 16, 2021.

(51) Int. Cl.
*A63C 13/00* (2006.01)
*A63C 5/00* (2006.01)

(52) U.S. Cl.
CPC ..... *A63C 13/005* (2013.01); *A63C 5/003* (2013.01)

(58) Field of Classification Search
CPC ..... A63C 13/005; A63C 5/003; A63C 7/102; A63C 9/086; A63C 13/001; A63C 13/003; A63C 13/006; A63C 5/128; A63C 2203/06; A63C 5/02; A63C 10/14
See application file for complete search history.

(56) References Cited

U.S. PATENT DOCUMENTS

| | | | | |
|---|---|---|---|---|
| 5,966,844 | A * | 10/1999 | Hellerman | A63C 5/02 280/809 |
| 6,195,919 | B1 * | 3/2001 | Forrest | A63C 13/005 36/97 |
| 7,681,904 | B2 * | 3/2010 | Ekberg | A63C 13/005 280/601 |
| 11,590,407 | B2 * | 2/2023 | Boren | A63C 10/02 |
| 2002/0017771 | A1 * | 2/2002 | McManus | A63C 5/02 280/600 |

FOREIGN PATENT DOCUMENTS

| | | | | |
|---|---|---|---|---|
| CA | 1278320 C | * | 12/1990 | A63C 13/001 |
| EP | 1123721 A1 | * | 8/2001 | A63C 13/003 |
| FR | 2477025 A1 | * | 2/1980 | |
| FR | 2477025 A1 | * | 9/1981 | |

* cited by examiner

*Primary Examiner* — James A Shriver, II
*Assistant Examiner* — Michael T. Walsh
(74) *Attorney, Agent, or Firm* — Workman Nydegger

(57) ABSTRACT

An apparatus for traveling across snow includes a ski having opposing ends, a top surface, a bottom surface, and an aperture extending therethrough between the top and bottom surfaces. The apparatus also includes a centerboard pivotally connected to the ski and disposed at least partially within the aperture in the ski. The apparatus further includes a binding plate configured to have a boot binding connected thereto.

19 Claims, 10 Drawing Sheets

SHOESKI

CROSS-REFERENCE TO RELATED APPLICATIONS

The present application claims priority to and the benefit of U.S. Provisional Application No. 63/211,415, filed Jun. 16, 2021, and entitled SHOESKI, the entire content of which is incorporated herein by reference.

BACKGROUND

Winter sports have been a long time and a growing area of recreation around the world. Winter sports include activities such as downhill skiing, cross-country skiing, snow shoeing, ice skating, sledding, and many other similar activities. These different activities can provide the benefits of helping people recreate outdoors, exposing people to high intensity action sports, and encouraging people to exercise.

Snowshoeing, in particular, has been a popular activity for individuals wanting to get outside and to workout. Snowshoeing provides the benefits of being relatively low-impact and having a shorter learning curve than some other winter sports. Snowshoes also provide an ideal means for traveling across snowy country sides, including hills and mountains.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

This disclosure relates to apparatuses and methods for traveling across snow. For example, in one embodiment, an apparatus for traveling across snow includes a ski, a centerboard, and a binding plate. The ski may have opposing ends, a top surface, a bottom surface, and an aperture extending therethrough between the top and bottom surfaces. The centerboard may be pivotally connected to the ski and disposed at least partially within the aperture in the ski. The binding plate may be configured to have a boot binding connected thereto.

In another embodiments, an apparatus for traveling across snow includes a ski and a centerboard. The ski may have a top surface, a bottom surface, and an aperture extending therethrough between the top and bottom surfaces. The centerboard may be connected to the ski and disposed at least partially within the aperture in the ski. The centerboard and the ski may be selectively reconfigurable between a ski mode and at least one snowshoe mode.

In yet another embodiment, a method for traveling across snow includes providing an apparatus that can be used as either a ski or a snowshoe, selectively configuring the apparatus into a ski mode, and selectively reconfiguring the apparatus into a snowshoe mode.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered to be limiting in scope, embodiments will be described and explained with additional specificity and detail through the use of the accompanying drawings in which.

DETAILED DESCRIPTION

Skiing and snowshoeing provide wonderful activities for getting exercise and visiting the outdoors. Skiing and snowshoeing provide similar benefits in that participants get exercise and are able to enjoy the outdoors. Disclosed embodiments provide individuals with the benefits of both snowshoes and skis in an efficient and easy to use apparatus. Additionally, disclosed embodiments provide advantages for climbing hills and descending hills that in many cases may surpass the performance of snowshoes and/or skis.

Attention is now directed to the Figures, which illustrate various perspective and cross-sectional views of an example apparatus, referred to herein as a shoeski 100, that can provide the benefits of both skis and snowshoes. More specifically, as discussed herein, the shoeski 100 can be arranged and used in a ski mode and one or more snowshoe modes. In the ski mode, the shoeski 100 allows a user to ski (e.g., slide on or over snow) on the shoeski 100. In contrast, the shoeski 100 allows a user to snowshoe (e.g., walk on top of snow) when the shoeski 100 is in a snowshoe mode.

While the Figures illustrate a single shoeski 100, it will be appreciated that a user may use a pair of shoeskis 100 when skiing and/or snowshoeing. Each shoeski 100 of a pair may be substantially identical and/or mirror images of one another. As such, a pair of shoeskis 100 may have a shoeski 100 for a user's left foot and a shoeski 100 for the user's right foot.

Figure 1A:
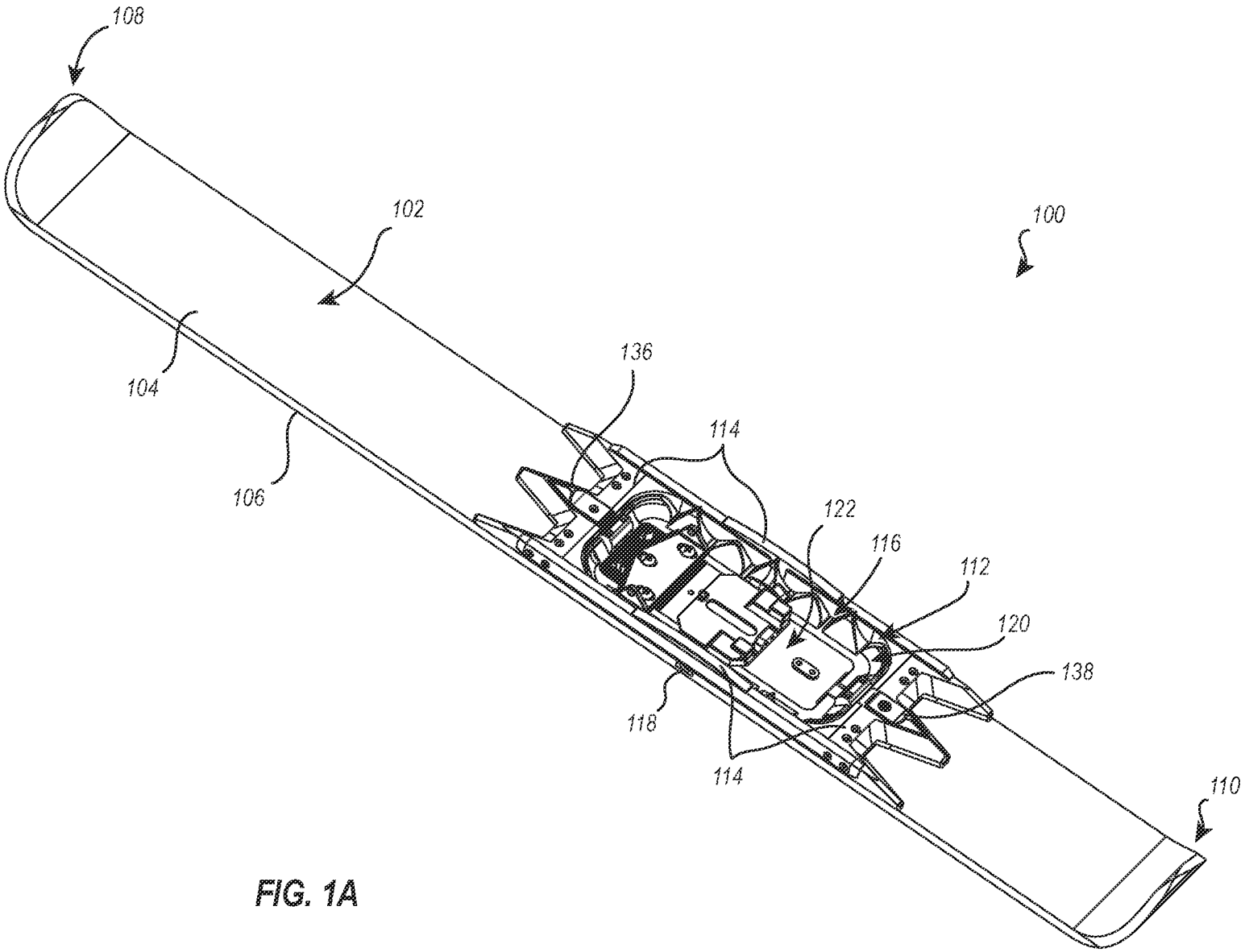
FIG. 1A illustrates a top perspective view of a shoeski according to one example embodiment.
Figure 1B:
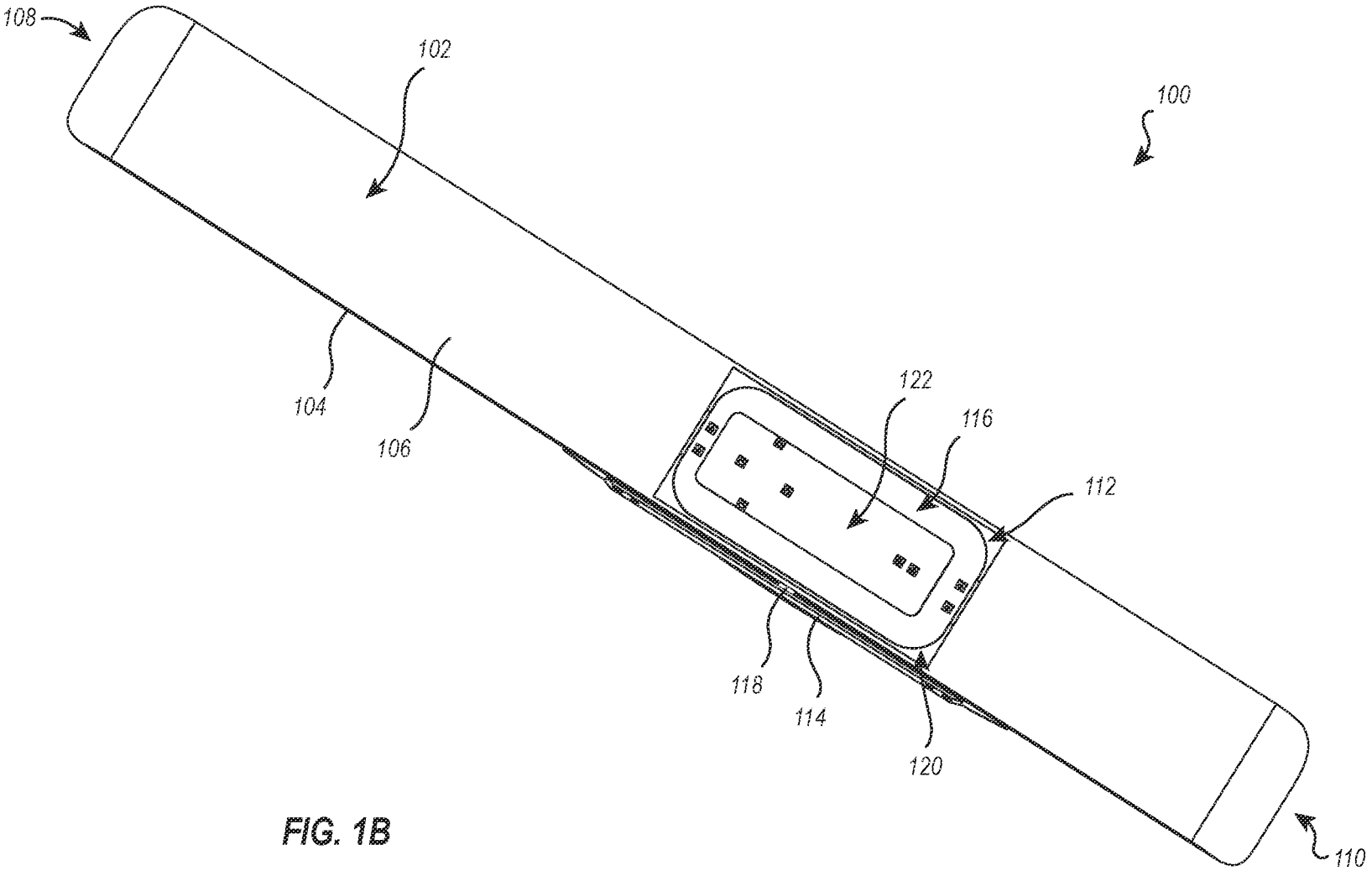
FIG. 1B illustrates a bottom perspective view of the shoeski of FIG. 1A.

FIGS. 1A and 1B illustrate top and bottom perspective views of the shoeski 100 in the ski mode. In the illustrated embodiment, the shoeski 100 includes a ski 102. In the illustrated embodiment, the ski 102 has a relatively narrow, elongate configuration. The length and width of the ski 102 may vary from one embodiment to another. The ski 102 also includes a top surface 104 and a bottom surface 106. As can be seen in FIG. 1B, the bottom surface 106 is generally smooth and planar. In the illustrated embodiment, the ski 102 also includes opposing ends 108, 110. One or both of the opposing ends 108, 110 may be curved upwards towards the top surface 104 of the ski 102. The upwardly curved opposing ends 108 and/or 110 may facilitate movement of the ski 102 over the snow as a user skis or snowshoes on the shoeski 100.

As can be seen in FIGS. 1A and 1B, an aperture 112 is formed in the ski 102. The aperture 112 extends through the ski 102 between the top and bottom surfaces 104, 106 thereof. In the illustrated embodiment, the aperture 112 has a generally rectangular shape. The illustrated shape of the aperture 112 is merely exemplary and the aperture 112 may have other shapes in other embodiments. Nevertheless, the aperture 112 may have a line of symmetry that extends laterally across the aperture 112. Half of the aperture 112 may be disposed on one side of the line of symmetry (towards the end 108) and another half of the aperture 112 may be disposed on a second side of the line of symmetry (towards the end 110). The two halves of the aperture 112 may be mirror images of one another.

In the illustrated embodiment, the shoeski 100 also includes one or more frame elements 114 mounted on the top surface 104 of the ski 102. The frame element(s) 114 may extend at least partially around the sides of the aperture 112. A centerboard 116 is mounted at least partially within the aperture 112. The centerboard 116 may be connected to the ski 102 and/or the frame element(s) 114 by way of one or more connection elements. For instance, the centerboard 116 may be connected to the ski 102 and/or the frame element(s) 114 via one or more pivot pins 118. The one or more pivot pins 118 may extend through the ski 102 and/or the frame element(s) 114 and into the centerboard 116. The pivot pin(s) 118 may be disposed along the line of symmetry of the aperture 112. Such a connection may enable the centerboard 116 to selectively pivot relative to the ski 102, as will be discussed in greater detail below. As will be discussed below in connection with FIGS. 2A and 2B, the centerboard 116 may also be connected to the ski 102 and/or the frame element(s) 114 with one or more locking components to limit or prevent pivoting of the centerboard 116 relative to the ski 102.

Similar to the aperture 112, the centerboard 116 may have a line of symmetry that extends laterally there across. The line of symmetry of the centerboard may be aligned with or parallel to the line of symmetry of the aperture 112. Additionally, the outer size and shape of the centerboard 116 may be similar or identical to the aperture 112.

A can be seen in FIGS. 1A and 1B, the centerboard 116 has an aperture 120 therein. Similar to the aperture 112, the aperture 120 extends through the centerboard between opposing sides thereof. As can be seen in FIGS. 1A and 1B, a binding plate 122 can be selectively mounted or otherwise disposed within the aperture 120. The binding plate 122 may include or be configured to have a boot binding connected thereto. The boot binding may facilitate the connection of a user's boot to the shoeski 100. In some embodiments, the boot binding may be configured to secure a snow boot to the shoeski 100. In other embodiments, the boot binding may be configured to secure a cross-country ski boot, a downhill ski boot, a snow boot, or other types of footwear to the shoeski 100.

As can be seen in FIG. 1B, when the shoeski 100 is in the ski mode, the bottom surfaces of the ski 102, the centerboard 116, and the binding plate 122 cooperate to form a generally smooth, planar bottom surface of the shoeski 100. That is, each of the ski 102, the centerboard 116, and the binding plate 122 has a smooth surface that face the same direction and cooperate with one another to form the generally smooth, planar surface of the shoeski 100 when in the ski mode. The generally smooth, planar surface of the shoeski 100 can be configured to allow a user to ski on or over snow with limited resistance.

Figure 2A:
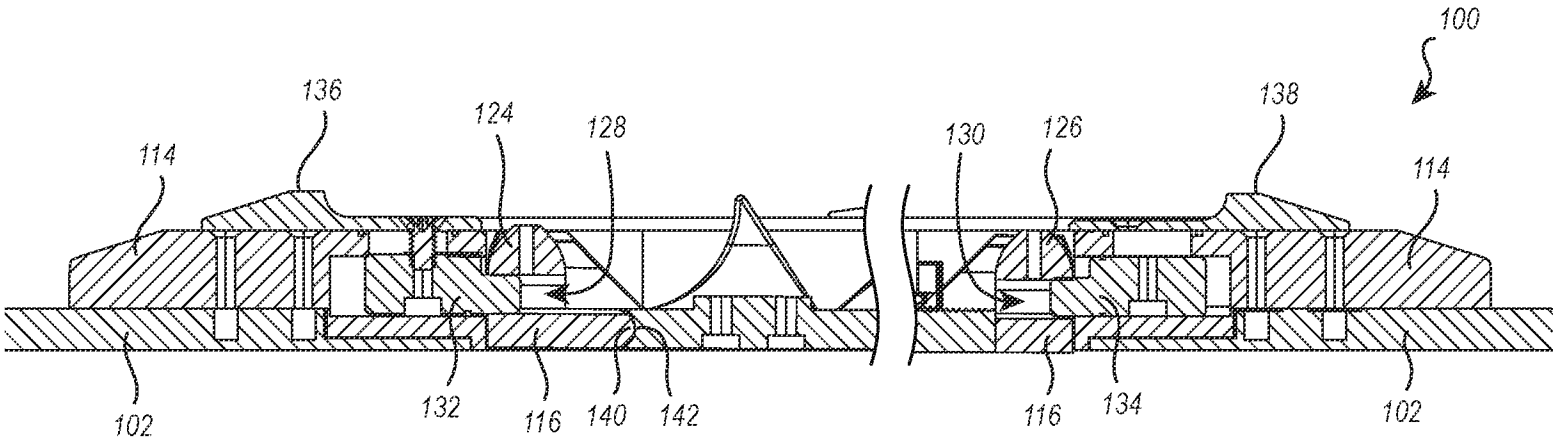
FIG. 2A illustrates a partial cross-sectional view of the shoeski of FIG. 1A.
Figure 2B:
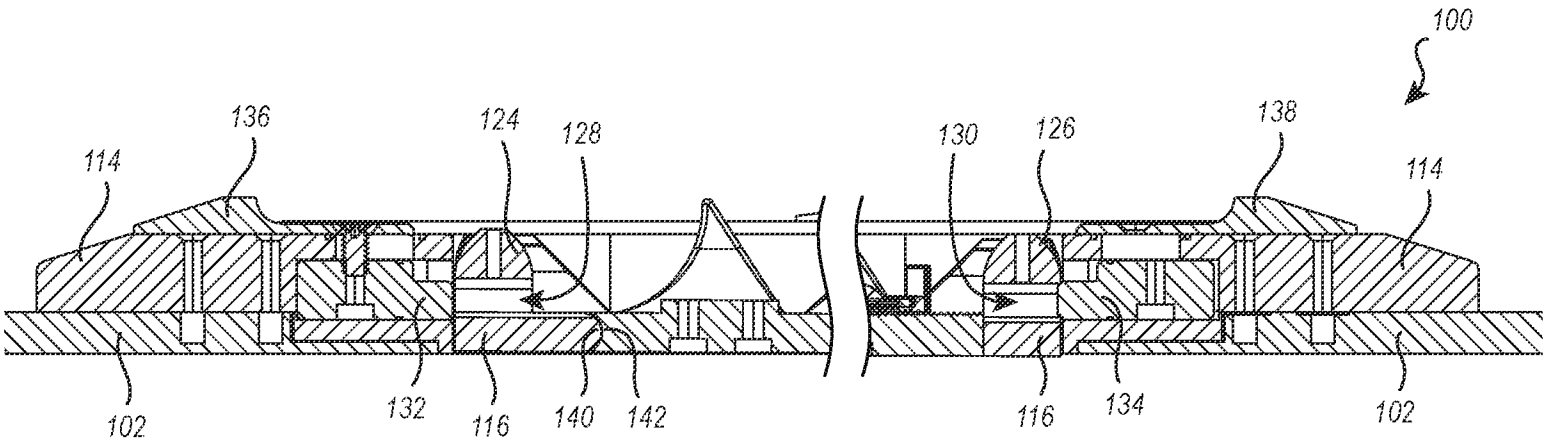
FIG. 2B illustrates another partial cross-sectional view of the shoeski of FIG. 1A.

With continued reference to FIGS. 1A and 1B, attention is now directed to FIGS. 2A and 2B, which illustrate one example embodiment of locking components that can be used in the shoeski 100 to limit or prevent to centerboard 116 from pivoting relative to the ski 102. FIGS. 2A and 2B illustrate partial cross-sectional views of the shoeski 100, with FIG. 2A illustrating the locking components in a locked configuration and FIG. 2B illustrating the locking components in an unlocked configuration.

In the illustrated embodiment, the centerboard 116 includes or has mounted thereon a first locking cap 124 and a second locking cap 126. The first and second locking caps 124, 126 are disposed at opposing ends of the centerboard 116. The first and second locking caps 124, 126 include receptacles 128, 130, respectively. The shoeski 100 also includes first and second locking clips 132, 134. In the illustrated embodiment, the first and second locking clips 132, 134 are mounted at least partially within the frame element(s) 114; however, the first and second locking clips 132, 134 could be mounted at least partially within the ski 102.

The first and second locking clips 132, 134 can be selectively moved between locked positions (FIG. 2A) and unlocked positions (FIG. 2B). As can be seen in FIG. 2A, the first and second locking clips 132, 134 extend into the receptacles 128, 130, respectively, in the first and second locking caps 124, 126 when the first and second locking clips 132, 134 are in the locked position. With the first and second locking clips 132, 134 in the locked position, the centerboard 116 is locked in place relative to the ski 102, thereby preventing the centerboard 116 from pivoting (about the pivot pin(s) 118) relative to the ski 102, or vice versa.

In contrast, as shown in FIG. 2B, the first and second locking clips 132, 134 are retracted from or do not extend into the receptacles 128, 130, respectively, in the first and second locking caps 124, 126. In this configuration, the first and second locking clips 132, 134 are in an unlocked position. With the first and second locking clips 132, 134 in the unlocked position, the centerboard 116 is free to pivot (about the pivot pin(s) 118) relative to the ski 102. The pivoting of the centerboard 116 will be discussed in greater detail below.

The first and second locking clips 132, 134 may be connected to tabs 136, 138, respectively. In the illustrated embodiment, the tabs 136, 138 are disposed on top of the frame element(s) 114. The tabs 136, 138 are movable towards and away from the centerboard 116. When the tabs 136, 138 are moved towards the centerboard 116, the first and second locking clips 132, 134 are moved to the locked positions. Conversely, when the tabs 136, 138 are moved away from the centerboard 116, the first and second locking clips 132, 134 are moved to the unlocked positions.

In some embodiments, the first and second locking clips 132, 134 may be biased to the locked positions (or to the unlocked positions). For instance, a biasing member (e.g., spring) may be positioned adjacent to each of the first and second locking clips 132, 134 and may bias the first and second locking clips 132, 134 toward the locked position. In other embodiments, one or more retention elements may be included to maintain the first and second locking clips 132, 134 in the locked and/or unlocked positions until a predetermined force is applied to move the first and second locking clips 132, 134 to the other position.

It will be appreciated that the number, type, and placement of the disclosed locking components used to secure the centerboard 116 to the ski 102 are merely exemplary. One or more than two locking components may be used. Additionally, the placement and type of such locking component(s) may vary from one embodiment to another.

Figure 3A:
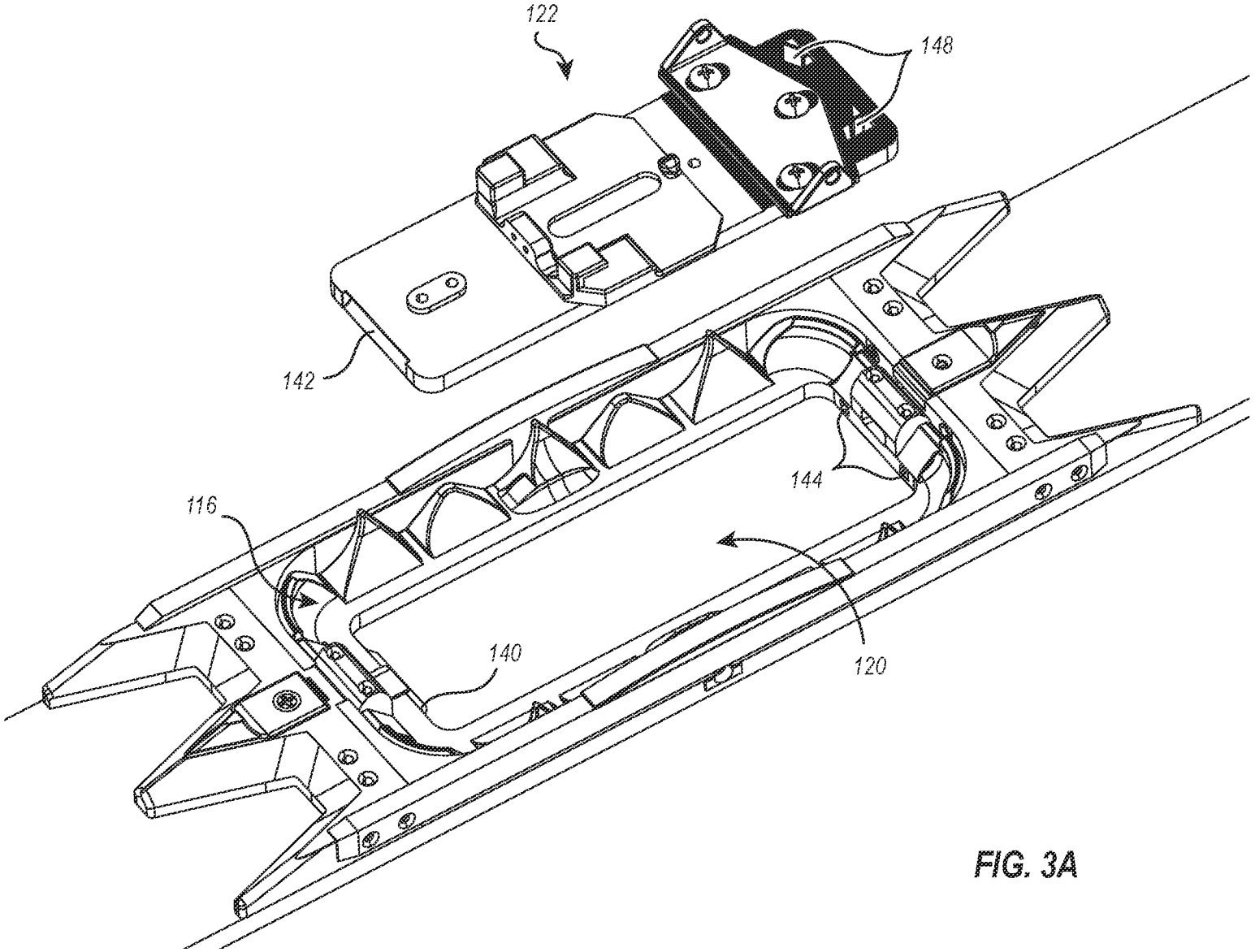
FIG. 3A illustrates a top perspective view of the shoeski of FIG. 1A with a binding plate thereof disconnected.
Figure 3B:
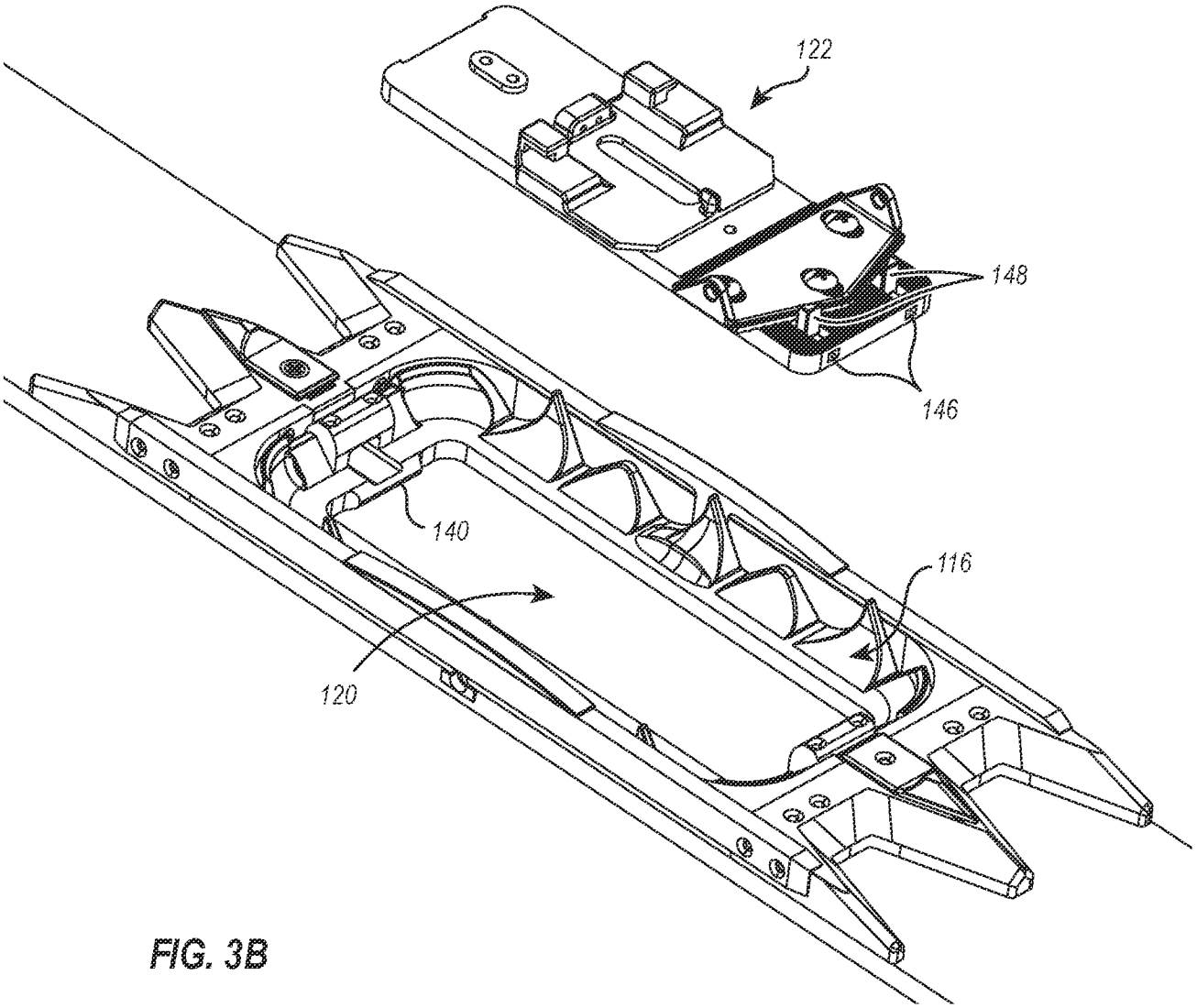
FIG. 3B illustrates another top perspective view of the shoeski of FIG. 1A with a binding plate thereof disconnected.

Attention is now directed to FIGS. 3A and 3B, which illustrate example securing mechanisms that may be employed to selectively connect the binding plate 122 to the centerboard 116. In the illustrated embodiment, the aperture 120 in the centerboard 116 includes a raised boss 140 and an end of the binding plate 122 includes a corresponding or mating recess 142. The binding plate 122 may be inserted into the aperture 120 of the centerboard 116 such that the boss 140 is disposed within or mates with the recess 142 in the binding plate 122 (as can be seen in FIGS. 2A and 2B). The boss 140 and recess 142 may cooperate to at least partially secure the binding plate 122 to the centerboard 116.

The centerboard 116 and the binding plate 122 may also include other securing mechanisms to further secure the components together. For instance, the centerboard 116 may include one or more receptacles 144 (e.g., that open into the aperture 120 in the centerboard 116) and the binding plate 122 may include one or more binding plate clips 146. Similar to the locking clips 132, 134, the binding plate clips 146 may be selectively moved between locked and unlocked positions. When in the unlocked position, the binding plate clips 146 may be retracted into the binding plate 122. In contrast, when in the locked position (as shown in FIG. 3B), the binding plate clips 146 may extend at least partially out of the binding plate 122 (e.g., out of a side surface thereof). The binding plate clips 146 may be configured to extend into the receptacles 144 in the centerboard 116 to secure the binding plate 122 to the centerboard 116.

As can be seen in FIGS. 3A and 3B, the binding plate clips 146 may include tabs 148 that extend out of the top surface of the binding plate 122. A user may engage the tabs 148 to move the binding plate clips 146 between the unlocked and/or locked positions. Similar to the first and second locking clips 132, 134, the binding plate clips 146 may be biased (e.g., via a spring) towards the locked or unlocked position. Additional retention elements may be included to selectively maintain the binding plate clips 146 in the locked or unlocked position unless a predetermined force is applied thereto.

The binding plate 122 may be selectively secured to the centerboard 116 by engaging the boss 140 and the recess 142 and then pivoting the other end of the binding plate 122 into the aperture 120 in the centerboard 116. Once the binding plate 122 is positioned within the aperture 120, the bind plate clips 146 may be engaged with the receptacles 144 in the centerboard 116. To remove the binding plate 122 from the centerboard 116, the remove process can be followed.

Figure 4:
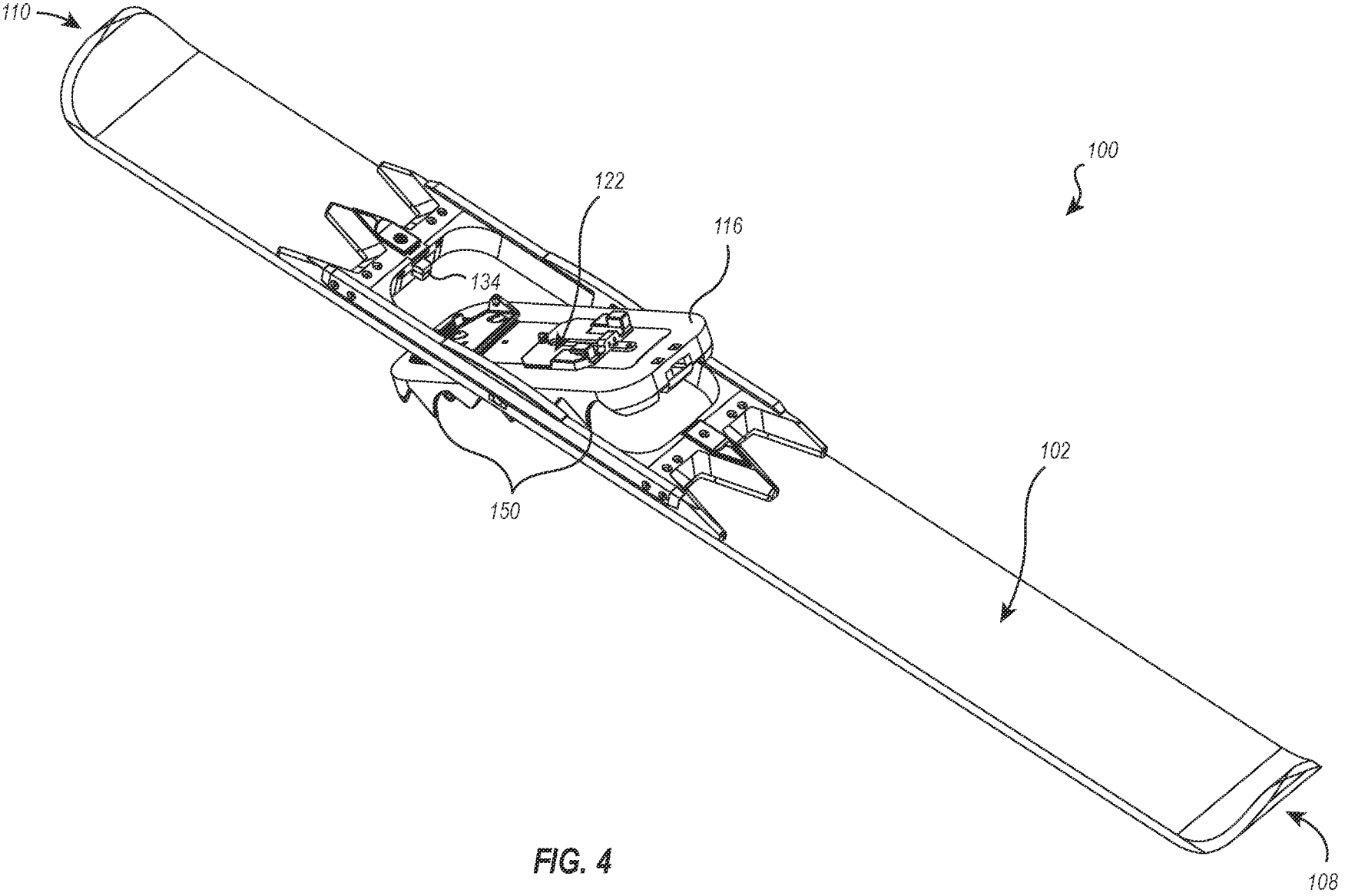
FIG. 4 illustrates the shoeski of FIG. 1A in a first snowshoe mode.

Attention is now directed to FIG. 4, which illustrates the shoeski 100 is a first snowshoe mode. As can be seen, the ends of the centerboard 116 have been disconnected from the ski 102 (e.g., by moving the first and second locking clips 132, 134 to the unlocked positions). Additionally, the centerboard 116 has been pivoted or rotated about the pivot pin(s) 118 compared to the ski mode shown in FIGS. 1A and 1B. In the illustrated embodiment, the centerboard 116 is illustrated as having been pivoted or rotated about 150°. However, the centerboard 116 can be rotated more or less than 150°.

As can be seen, the now primarily downwardly facing surface of the centerboard 116 (i.e., the surface of the centerboard 116 that generally faces in the same direction as the bottom surface 106 of the ski 102) includes a plurality of traction elements 150. In the illustrated embodiment, the traction elements 150 include spikes disposed around the perimeter of the centerboard 116.

In addition to pivoting the centerboard 116, the binding plate 122 has been remounted to the centerboard 116. In particular, the binding plate 122 has been mounted to the centerboard 116 so that the boot bindings will be disposed on the side of the centerboard 116 opposite to the traction elements 150. Furthermore, with the centerboard 116 pivoted as shown, the binding plate 122 mounts to the centerboard 116 facing in the opposite direction compared to the ski mode shown in FIGS. 1A and 1B. In particular, in the ski mode, the binding plate 122 is mounted so that the end 108 and a longer portion of the ski 102 are in front of the user. In contrast, in the snowshoe mode, the binding plate 122 is mounted so that the end 110 and a shorter portion of the ski 102 is in front of the user.

When the shoeski 100 is used in the illustrated snowshoe mode, the centerboard 116 and connected binding plate 122 can freely pivot about the pivot pin(s) 118, thereby enabling the user to use a snowshoe or walking gait. Additionally, the downwardly facing traction elements 150 can extend into the snow or ground to provide traction, thereby enable a user to climb hills, etc.

In some embodiments, it is desirable to limit the pivoting range of the centerboard 116 and connected binding plate 122 relative to the ski 102. For instance, it may be desirable to prevent the end 110 of the ski 102 from pivoting below the now front ends of the centerboard 116 and binding plate 122. If the end 110 of ski 102 gets caught in snow or below something else, the ski 102 may try to pivot so that the end 108 thereof swings up towards the user. To prevent this, the second locking clip 134 may be moved to the locked position so that it extends into the aperture 112 of the ski 102, as shown in FIG. 4. In this configuration, the second locking clip 134 does not engage with either of the receptacles 128, 130 of the centerboard 116 like in the ski mode. However, if the end 110 of ski 102 tries to pivot too far down, the second locking clip 134 will engage the centerboard 116 and prevent further rotation of the ski 102 relative to the centerboard 116.

Figure 5A:
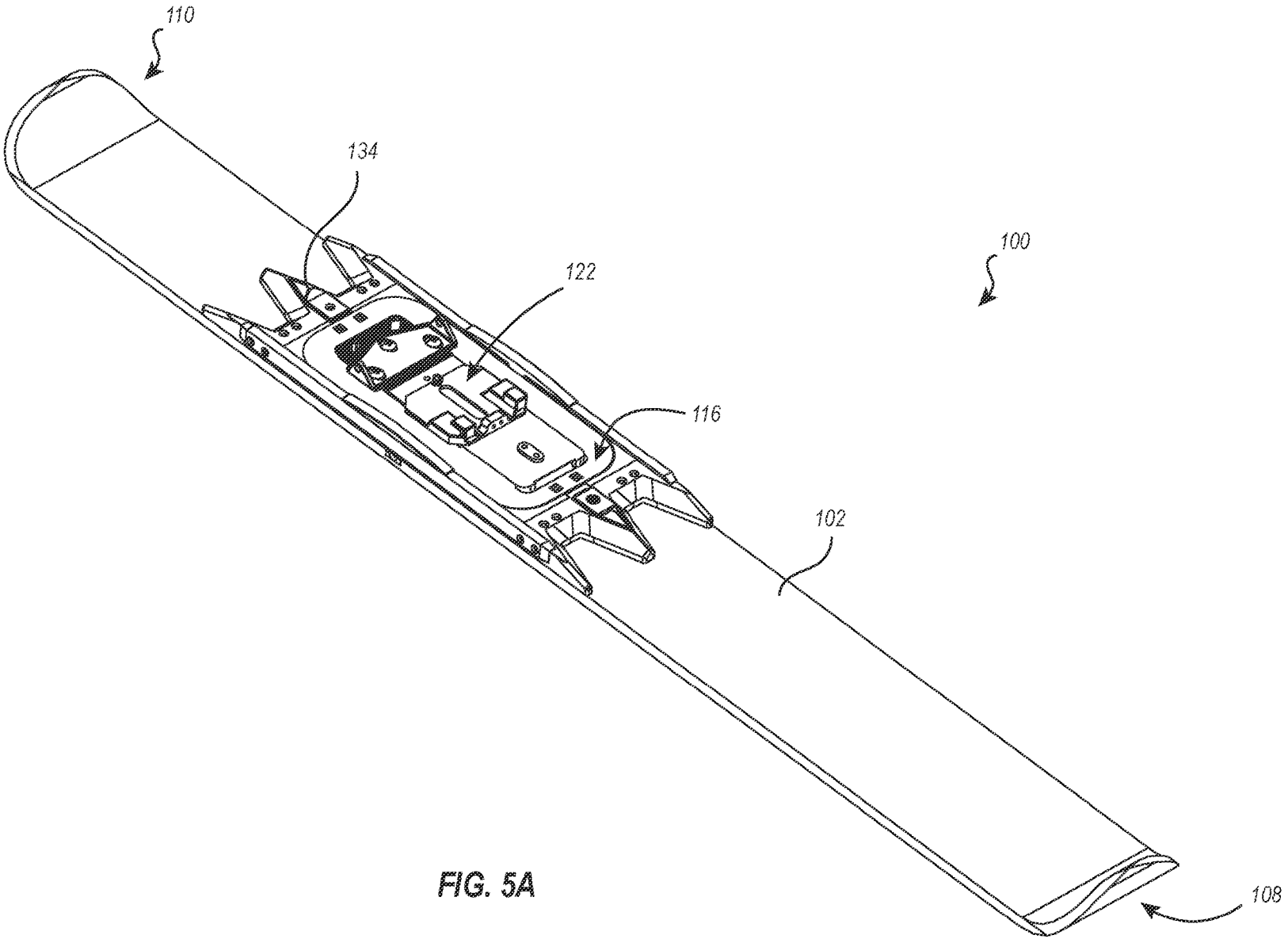
FIG. 5A illustrates a top perspective view of the shoeski of FIG. 1A in a second snowshoe mode.
Figure 5B:
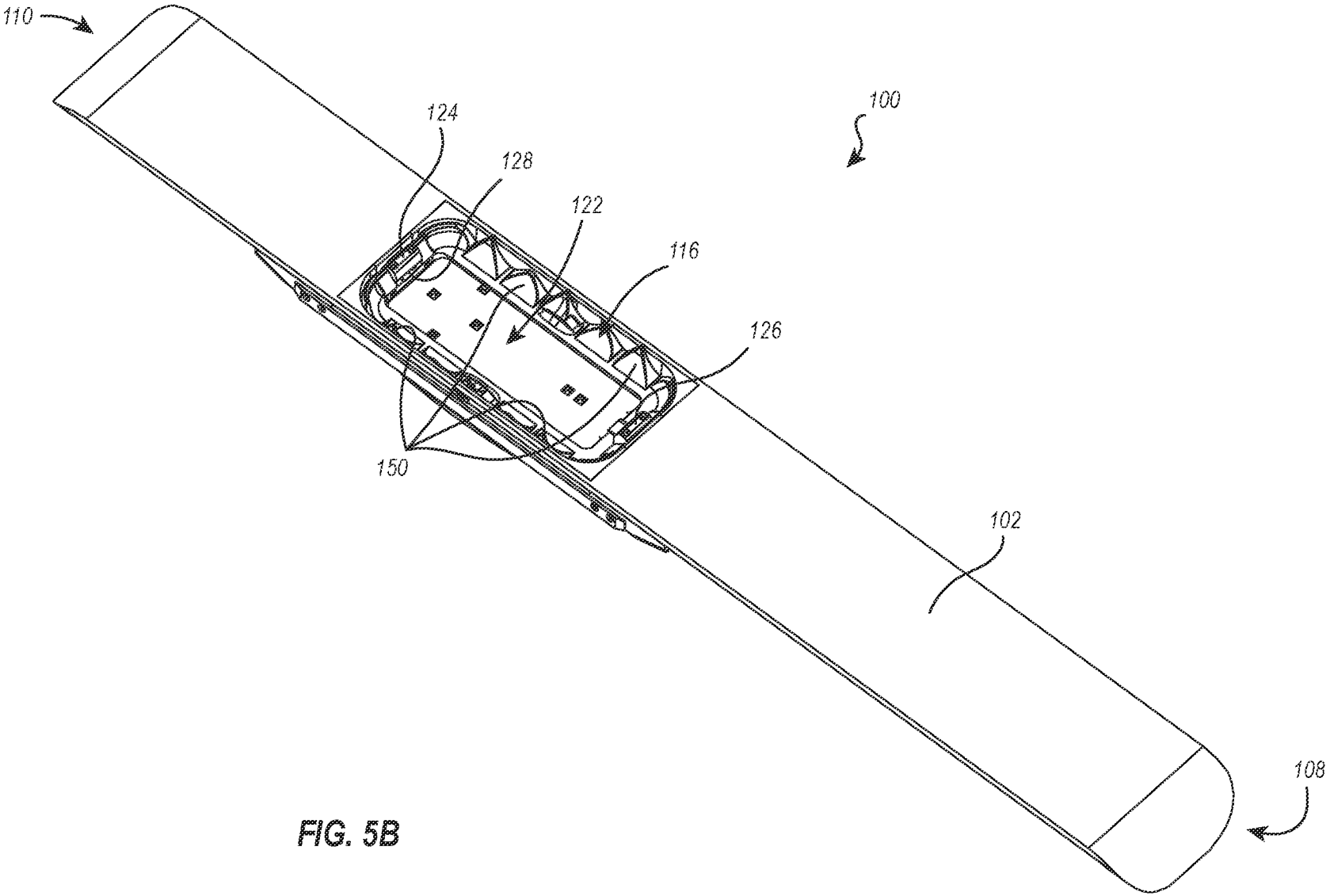
FIG. 5B illustrates a bottom perspective view of the shoeski of FIG. 5A.

FIGS. 5A and 5B illustrate the shoeski 100 in a second snowshoe configuration. This snowshoe configuration is similar to that of FIG. 4. In contrast to FIG. 4, however, the centerboard 116 has been rotated about the pivot pin(s) 118 by 180° compared to the ski mode shown in FIGS. 1A and 1B. That is, the smooth surface of the centerboard 116 that faced the same direction as the bottom surface 106 of the ski 102 in the ski mode, now faces in the opposite direction from the bottom surface 106. As a result, the surface of the centerboard 116 that includes the traction elements 150 now faces in the same direction as the bottom surface 106 of the ski 102.

Also, unlike FIG. 4, the centerboard 116 has been secured to the ski 102 in a manner to prevent relative pivoting or rotation therebetween. In particular, the first and second locking clips 132, 134 have been engaged with the second and first receptacles 130, 128, respectively. Thus, similar to the ski mode, the centerboard 116 and ski 102 are connected together to prevent rotation therebetween. However, in the illustrated snowshoe mode, the traction elements 150 face the same direction as the bottom surface 106 of the ski 102 to provide traction with the ground.

Figure 6:
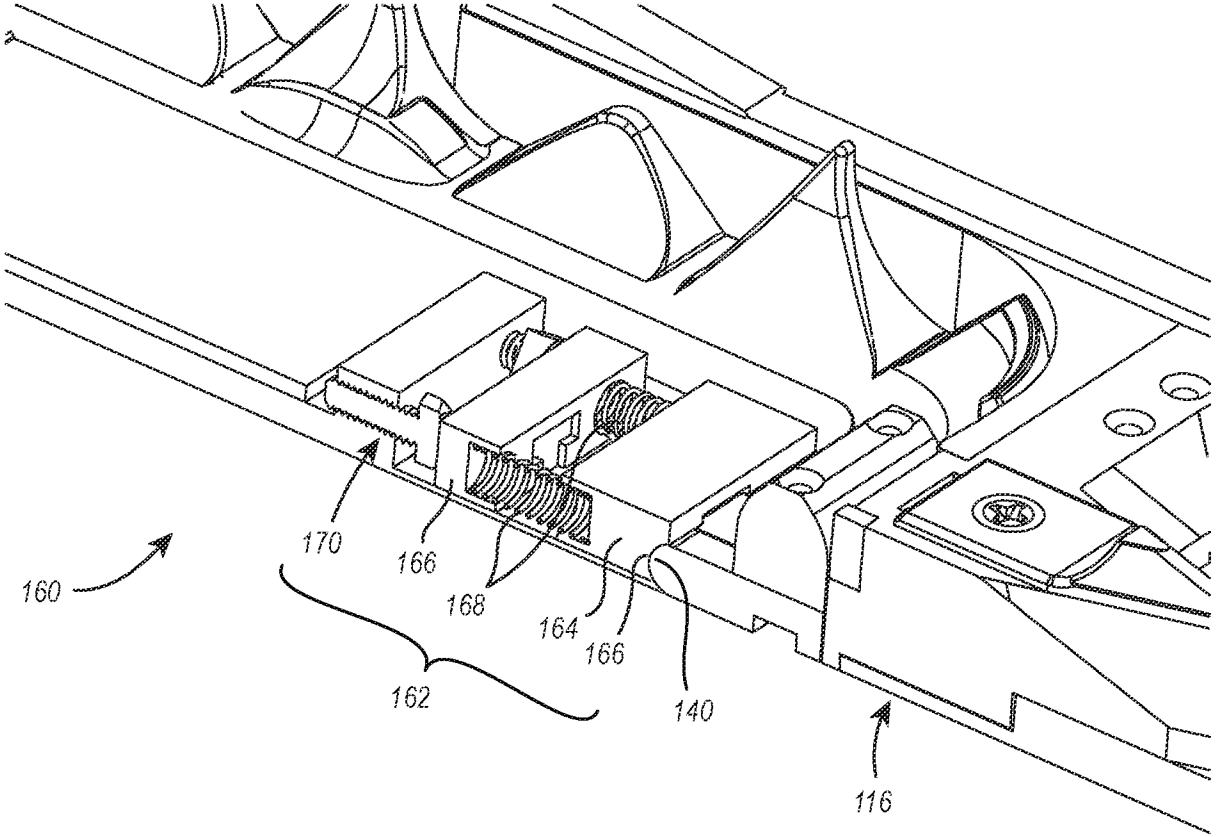
FIG. 6 illustrates a binding plate release mechanism.

Attention is now directed to FIG. 6, which illustrates a partial cross-sectional view of an example embodiment of a binding plate 160. Except as otherwise described, the binding plate 160 may be substantially the same or similar to the binding plate 122. The binding plate 160 may be mounted to or removed from the centerboard 116 in the same or similar manner as the binding plate 122.

In contrast to the binding plate 122, the binding plate 160 includes a release mechanism 162. The release mechanism 162 includes recess block 164. The recess block 164 includes a recess 166 that can engage the boss 140 on the centerboard 116 in a manner similar to that of the recess 142 in the binding plate 122. The release mechanism 162 also includes a spring block 167, one or more biasing members 168, and an adjustment mechanism 170.

The one or more biasing members 168 may be disposed between the recess block 164 and the spring block 167. The one or more biasing members 168 may bias or urge the recess block 164 away from the spring block 167 and towards the boss 140 on the centerboard 116. The one or more biasing members 168 may take a variety of forms, including coil springs.

The position of the spring block 167 may be selectively adjusted using the adjustment mechanism 170. The adjustment mechanism 170 may include one or more bolts disposed between a main body portion of the binding plate 160 and the spring block 167. Rotation of the one or more bolts may move the spring block 167 towards or away from the recess block 164. Movement of the spring block 167 towards the recess block 164 may increase the biasing force applied by the one or more biasing members 168 to the recess block 164. Conversely, movement of the spring block 167 away from the recess block 164 may decrease the biasing force applied by the one or more biasing members 168 to the recess block 164.

The release mechanism 162 may facilitate the release or disconnection of the binding plate 160 from the centerboard 116. For instance, if the user were to fall or the ski 102 were to get caught on something, or a similar event, it may be desirable for the binding plate 160 to disconnect from the centerboard 116 without requiring intentional action by the user (e.g., moving the tabs 148 to disengage the binding plate clips 146 from the receptacles 144 in the centerboard 116). More specifically, the forces from such an event may overcome the biasing force of the biasing members 168 (e.g., thereby compressing or flexing the biasing members 168), which would allow the recess block 164 to move or pivot away from the boss 140 and allow the binding plate 160 to disconnect from the centerboard 116.

As noted above, the adjustment mechanism 170 may allow for adjustments to be made to the biasing force applied by the biasing members 168. As the biasing force is reduced, the binding plate 160 can be released from the centerboard 116 with less force. In contrast, as the biasing force is increased, more force is necessary to release the binding plate 160 from the centerboard 116.

Figure 7:
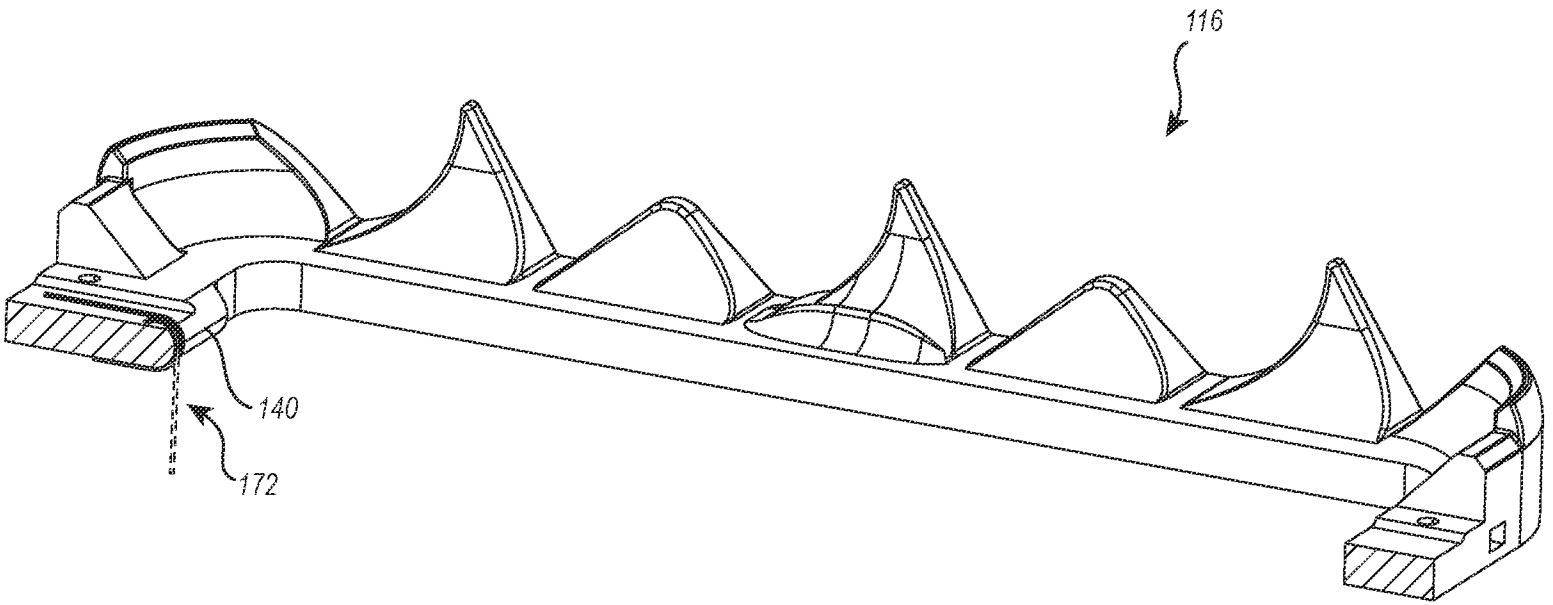
FIG. 7 illustrates a cross-sectional view of a centerboard with spring-loaded rods.

Attention is now directed to FIG. 7, which illustrates a cross-sectional view of another embodiment of a centerboard 116. The centerboard 116 of FIG. 7 may be the same as or similar to the other centerboards 116 discussed herein. In the embodiment of FIG. 7, the centerboard 116 also includes one or more spring-loaded rods 172 connected thereto. The spring-loaded rods 172 (or a portion thereof) may be positioned in an undeployed state (shown in solid lines) or a deployed state (shown in dashed lines). As shown, in the undeployed state, the spring-loaded rods 172 (or a portion thereof) may be pivoted, folded, or otherwise retracted into or flush with a portion of the shoeski 100. As also shown, in the deployed state, the one or more spring-loaded rods 172 (or a portion thereof) may be pivoted, folded, or otherwise extended from or out of the shoeski 100. In the undeployed state, the spring-loaded rods 172 may not inhibit the functioning of the shoeski 100. That is, the spring-loaded rods 172 may not inhibit the shoeski 100 from sliding over snow. In contrast, when in the deployed state, the spring-loaded rods 172 may help to restrict the shoeski 100 from sliding over the snow. In some embodiments, the spring-loaded rods 100 may be biased towards the deployed state.

In some embodiments, such as that shown in FIG. 7, the spring-loaded rods 172 may be connected to the centerboard 116 (e.g., near the raised boss 140). When the binding plate 122 is connected to the centerboard 116, the binding plate 122 (or a portion thereof, such as the recess 142) may engage the spring-loaded rods 172 and move the spring-loaded rods 172 from the deployed state to the undeployed state. Conversely, when the binding plate 122 is disconnected from the centerboard 116, the spring-loaded rods 172 may disengage the spring-loaded rods 172 and allow the spring-loaded rods 172 to move to the deployed state. In the deployed state, the spring-loaded rods 172 may raise the ski 102 partially off of the snow or otherwise interact with the snow to limit or prevent the shoeski 100 from sliding over the snow. For instance, if a user falls and the binding plate 122 becomes disconnected from the centerboard 116, the spring-loaded rods 172 may prevent the rest of the shoeski 100 from sliding away from the user.

Disclosed embodiments can be made from carbon fiber or a plastic material but is not limited to these materials. Disclosed embodiments can be made from any material in the industry that fits its application. Disclosed embodiments can be made by injection molding but is not limited to injection molding. It could be made by any industry standard that it requires to function. The thickness, width, and length may vary based upon the end-user's size and weight.

In light of the disclosure herein, it will be appreciated that an apparatus for traveling across snow may include a ski, a centerboard, and a binding plate. The ski may have opposing ends, a top surface, a bottom surface, and an aperture extending therethrough between the top and bottom surfaces. The centerboard may be pivotally connected to the ski and disposed at least partially within the aperture in the ski. The binding plate may be configured to have a boot binding connected thereto.

In some embodiments, one or both of the opposing ends of the ski comprise curved tips.

In some embodiments, the apparatus also includes one or more locking mechanisms configured to selectively limit or prevent the centerboard from pivoting relative to the ski.

In some embodiments, the one or more locking mechanisms comprise one or more locking clips mounted on the ski and one or more associated receptacles in the centerboard, the one or more locking clips may be selectively insertable into or removable from the one or more associated receptacles to prevent or allow the centerboard to pivot relative to the ski.

In some embodiments, the centerboard includes a first side having a generally smooth, planar surface.

In some embodiments, the centerboard includes a second side having one or more traction elements, the second side being opposite to the first side.

In some embodiments, the binding plate is selectively connectable to and removable from the centerboard.

In some embodiments, the binding plate is connected to either a first side of the centerboard or a second side of the centerboard.

In some embodiments, the centerboard comprises an aperture extending therethrough, the binding plate being selectively mountable within the aperture in the centerboard.

In some embodiments, the aperture in the centerboard comprises a raised boss and the binding plate comprising a corresponding recess.

In some embodiments, the binding plate comprises one or more locking clips and the centerboard comprises one or more receptacles for selectively receiving the one or more locking clips to connect the binding plate to the centerboard.

In one example embodiment, an apparatus for traveling across snow includes a ski having a top surface, a bottom surface, and an aperture extending therethrough between the top and bottom surfaces. The apparatus also includes a centerboard connected to the ski and disposed at least partially within the aperture in the ski, the centerboard and the ski being selectively reconfigurable between a ski mode and at least one snowshoe mode.

In some embodiments, the centerboard is pivotally mounted within the aperture in the ski.

In some embodiments, the apparatus also includes a binding plate configured to have a boot binding connected thereto.

In some embodiments, the centerboard comprises an aperture therethrough and the binding plate being selectively mountable within the aperture in the centerboard.

In some embodiments, the centerboard comprises a first side having generally planar surface and an opposing second side having one or more traction elements thereon.

In some embodiments, the binding plate is selectively mountable in the aperture of the centerboard such that a boot binding connected to the binding plate can be disposed on either the first side or the second side of the centerboard.

In another example embodiment, a method for traveling across snow includes providing an apparatus that can be used as either a ski or a snowshoe, selectively configuring the apparatus into a ski mode, and selectively reconfiguring the apparatus into a snowshoe mode.

In some embodiments, selectively configuring the apparatus into a ski mode comprises arranging two or more elements of the apparatus to form a generally smooth bottom surface.

In some embodiments, selectively reconfiguring the apparatus into a snowshoe mode comprising allowing a first component of the apparatus to pivot relative to a second component, the first component having a first side with smooth surface and a second side with one or more traction elements, the second component having a bottom surface that is smooth.

The present invention may be embodied in other specific forms without departing from its spirit or characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for traveling across snow, the apparatus being selectively reconfigurable between a ski mode and a snowshoe mode, the apparatus comprising:

a ski having opposing ends, a top surface, a bottom surface, and an aperture extending therethrough between the top and bottom surfaces;

a centerboard having a first side, a second side, and an aperture extending therethrough between the first and second sides, the centerboard being pivotally connected to the ski and disposed at least partially within the aperture in the ski; and a binding plate having a first side configured to have a boot binding connected thereto and a second side, the binding plate being selectively mountable within the aperture in the centerboard, wherein, in the ski mode, the bottom surface of the ski, the first side of the centerboard, and the second side of the binding plate cooperate to form a generally smooth, planar bottom surface of the apparatus.

2. The apparatus of claim 1, wherein one or both of the opposing ends of the ski comprise curved tips.

3. The apparatus of claim 1, further comprising one or more locking mechanisms configured to selectively limit or prevent the centerboard from pivoting relative to the ski.

4. The apparatus of claim 3, wherein the one or more locking mechanisms comprise one or more locking clips mounted on the ski and one or more associated receptacles in the centerboard, the one or more locking clips being selectively insertable into or removable from the one or more associated receptacles to prevent or allow the centerboard to pivot relative to the ski.

5. The apparatus of claim 1, wherein the first side of the centerboard comprises a generally smooth, planar surface.

6. The apparatus of claim 5, wherein the second side of the centerboard comprises one or more traction elements, the second side being opposite to the first side.

7. The apparatus of claim 1, wherein the binding plate is selectively connectable to and removable from the centerboard.

8. The apparatus of claim 7, wherein the binding plate is connectable to either a first side of the centerboard or a second side of the centerboard.

9. The apparatus of claim 1, wherein a first end of the aperture in the centerboard comprises a raised boss and a first end of the binding plate comprising a corresponding recess.

10. The apparatus of claim 9, wherein a second end of the binding plate comprises one or more locking clips and a second end of the aperture in the centerboard comprises one or more receptacles for selectively receiving the one or more locking clips to connect the binding plate to the centerboard.

11. An apparatus for traveling across snow, comprising:

a ski having a top surface, a bottom surface, and an aperture extending therethrough between the top and bottom surfaces;

a centerboard connected to the ski and disposed at least partially within the aperture in the ski, the centerboard comprising a first side that is generally smooth and a second side that comprises one or more traction elements, the centerboard and the ski being selectively reconfigurable between a ski mode and at least one snowshoe mode; and a plurality of locking features comprising:

one or more locking features at a front end of the aperture;

one or more locking features at a rear end of the aperture;

one or more corresponding locking features at a front end of the centerboard; and one or more corresponding locking features at a rear end of the centerboard, wherein, in the ski mode, the one or more locking features at the front end of the aperture and the one or more corresponding locking features at the front end of the centerboard are configured to engage one another and the one or more locking features at the rear end of the aperture and the one or more corresponding locking features at the rear end of the centerboard are configured to engage one another, and wherein, in the snowshoe mode, the one or more locking features at the front end of the aperture and the one or more corresponding locking features at the rear end of the centerboard are configured to engage one another and the one or more locking features at the rear end of the aperture and the one or more corresponding locking features at the front end of the centerboard are configured to engage one another.

12. The apparatus of claim 11, wherein the centerboard is pivotally mounted within the aperture in the ski.

13. The apparatus of claim 11, further comprising a binding plate configured to have a boot binding connected thereto.

14. The apparatus of claim 13, wherein the centerboard comprises an aperture therethrough and the binding plate is selectively mountable within the aperture in the centerboard.

15. The apparatus of claim 14, wherein the centerboard comprises a first side having generally planar surface and an opposing second side having one or more traction elements thereon.

16. The apparatus of claim 15, wherein the binding plate is selectively mountable in the aperture of the centerboard such that a boot binding connected to the binding plate can be disposed on either the first side or the second side of the centerboard.

17. A method for traveling across snow, comprising:

providing an apparatus according to claim 1 that can be used as either a ski or a snowshoe;

selectively configuring the apparatus into a ski mode; and selectively reconfiguring the apparatus into a snowshoe mode.

18. The method of claim 17, wherein selectively configuring the apparatus into a ski mode comprises arranging two or more elements of the apparatus to form a generally smooth bottom surface.

19. The method of claim 17, wherein selectively reconfiguring the apparatus into a snowshoe mode comprising allowing the centerboard to pivot relative to the ski, the centerboard having a first side with a smooth surface and a second side with one or more traction elements, the ski having a bottom surface that is smooth.

* * * * *